US008939446B2

(12) United States Patent
Ichikawa

(10) Patent No.: US 8,939,446 B2
(45) Date of Patent: Jan. 27, 2015

(54) ROLLER DEVICE

(71) Applicant: Hiroshi Ichikawa, Okazaki (JP)

(72) Inventor: Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/949,709

(22) Filed: Jul. 24, 2013

(65) Prior Publication Data

US 2014/0084534 A1 Mar. 27, 2014

(30) Foreign Application Priority Data

Jul. 24, 2012 (JP) ..... 2012-163478

(51) Int. Cl.
*B65H 3/06* (2006.01)
*B65H 3/32* (2006.01)
*B65H 5/06* (2006.01)

(52) U.S. Cl.
CPC .. *B65H 3/32* (2013.01); *B65H 5/06* (2013.01); *B65H 2402/40* (2013.01); *B65H 2402/31* (2013.01); *B65H 3/0638* (2013.01); *B65H 3/0684* (2013.01); *B65H 3/0676* (2013.01)
USPC ..... 271/109; 271/117

(58) Field of Classification Search
CPC ..... B65H 3/06; B65H 3/0638; B65H 3/0676; B65H 3/0684; B65H 2402/10; B65H 2402/30; B65H 2402/31; B65H 2402/40; B65H 2402/522
USPC ..... 271/109, 117
See application file for complete search history.

(56) References Cited

U.S. PATENT DOCUMENTS

| | | | | |
|---|---|---|---|---|
| 5,421,569 | A * | 6/1995 | Davidson | 271/109 |
| 7,413,184 | B2 * | 8/2008 | Lai | 271/117 |
| 7,445,206 | B2 * | 11/2008 | Lee | 271/117 |
| 7,543,811 | B2 * | 6/2009 | Shimamura | 271/124 |
| 7,694,954 | B2 * | 4/2010 | Lee | 271/117 |
| 8,439,353 | B2 * | 5/2013 | Tamehira et al. | 271/121 |
| 8,544,839 | B2 * | 10/2013 | Ichikawa | 271/121 |
| 8,550,450 | B2 * | 10/2013 | Liu | 271/121 |
| 8,655,255 | B2 * | 2/2014 | Ichikawa | 399/388 |
| 2006/0180987 | A1 | 8/2006 | Hattori | |

FOREIGN PATENT DOCUMENTS

| | | | |
|---|---|---|---|
| JP | 7-285688 | A | 10/1995 |
| JP | 2006-096479 | A | 4/2006 |

* cited by examiner

*Primary Examiner* — David H Bollinger
(74) *Attorney, Agent, or Firm* — Banner & Witcoff, Ltd.

(57) ABSTRACT

A roller device may include a main body, a first roller configured to rotate around an first axis line extending in a predetermined axial direction, the first roller including an end portion in the axial direction, and a supporting member including a first supporting portion configured to rotatably support the end portion of the first roller and an engaging portion configured to engage the main body. Further, the main body including a regulating portion disposed inside the movable range when the supporting member is located at a third position and disposed outside the movable range when the supporting member is located at a fourth position.

33 Claims, 17 Drawing Sheets

SEPARATED POSITION

SHEETFEEDING POSITION

DISENGAGED POSITION

ROLLER DEVICE

CROSS-REFERENCE TO RELATED APPLICATION

This application claims priority to Japanese Patent Application No. 2012-163478, filed on Jul. 24, 2012, the content of which is incorporated herein by reference in its entirety.

TECHNICAL FIELD

Aspects of the disclosure relate to a roller device that may include a holding member including a holding portion for rotatably holding a roller, and a main body to which the holding member is attachable.

BACKGROUND

A known image forming apparatus includes a known roller device that includes a pickup roller, a sheet separating roller, a holding member, and a main body. The pickup roller is configured to feed one or more sheets from a sheet feed tray. The sheet separating roller is disposed downstream of the pickup roller with respect to a sheet conveying direction. The holding member is configured to rotatably hold the pickup roller and the sheet separating roller. The main body is configured to receive the holding member that is attachable to the main body. The pickup roller is rotatably held by a pair of side walls of the holding member.

BRIEF SUMMARY

In the known roller device, when the pickup roller is replaced with a new one, the holding member holding the pickup roller and the sheet separating roller may be removed from the main body. When an external force is applied to one or both of the side walls of the holding member while the pickup roller is attached to the main body via the holding member, the one or both of the side walls may be deformed due to the external force and thus the pickup roller may be undesirably disengaged from the holding member. As a result, the image forming apparatus may not be able to perform an image forming operation.

Aspects of the disclosure relate to a roller device which may include a main body, a first roller configured to rotate around an first axis line extending in a predetermined axial direction, the first roller including an end portion in the axial direction, and a supporting member including a first supporting portion configured to rotatably support the end portion of the first roller and an engaging portion configured to engage the main body. Further, the first supporting portion is movable within a movable range between a first position and a second position, the first supporting member supports the end portion of the first roller at the first position, and the first supporting member is disengaged from and disposed outside adjacent to the end portion of the first roller at the second position. Further, the supporting member is movable between a third position and a fourth position. The engaging portion engages the main body when the supporting member is located at the third position, and the engaging portion is disengaged from the main body when the supporting member is located at the fourth position. Further, the regulating portion is disposed inside the movable range when the supporting member is located at the third position and disposed outside of the movable range when the supporting member is located at the fourth position.

Aspects of the disclosure relate to a roller device which may include a roller having an engaging portion; a first supporting portion configured to rotatably support the engaging portion of the roller, wherein the first supporting portion is configured to be movable in a moving range between a first position in which the engaging portion is supported by the first supporting portion and a second position at which the engaging portion initially becomes disengaged from the first supporting portion; and a regulating portion positioned within the moving range of the first supporting portion between the first position and the second position.

Aspects of the disclosure relate to a roller device which may include a roller having a shaft; a supporting portion having a bearing configured to receive and rotatably support the shaft, wherein the supporting portion is configured to move within a range between a first position in which the shaft is received in the bearing and a second position in which a surface of the bearing facing the roller in the axial direction is located at an axial end surface of the shaft; and a regulating portion located within the moving range of the supporting portion.

Aspects of the disclosure relate to a roller device which may include a roller having a recess; a supporting portion having a shaft configured to be received within the recess of the roller, wherein the supporting portion is configured to move within a range between a first position in which the shaft is received in the recess and a second position in which an axial surface of the roller adjacent to the recess is located at a same axial position as an end surface of the shaft; and a regulating portion located within the moving range of the supporting portion.

Other objects, features, and advantages will be apparent to persons of ordinary skill in the art from the following detailed description of the disclosure and the accompanying drawings.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION OF EMBODIMENT

An illustrative embodiment is described in detail with reference to the accompanying drawings.

Figure 1:
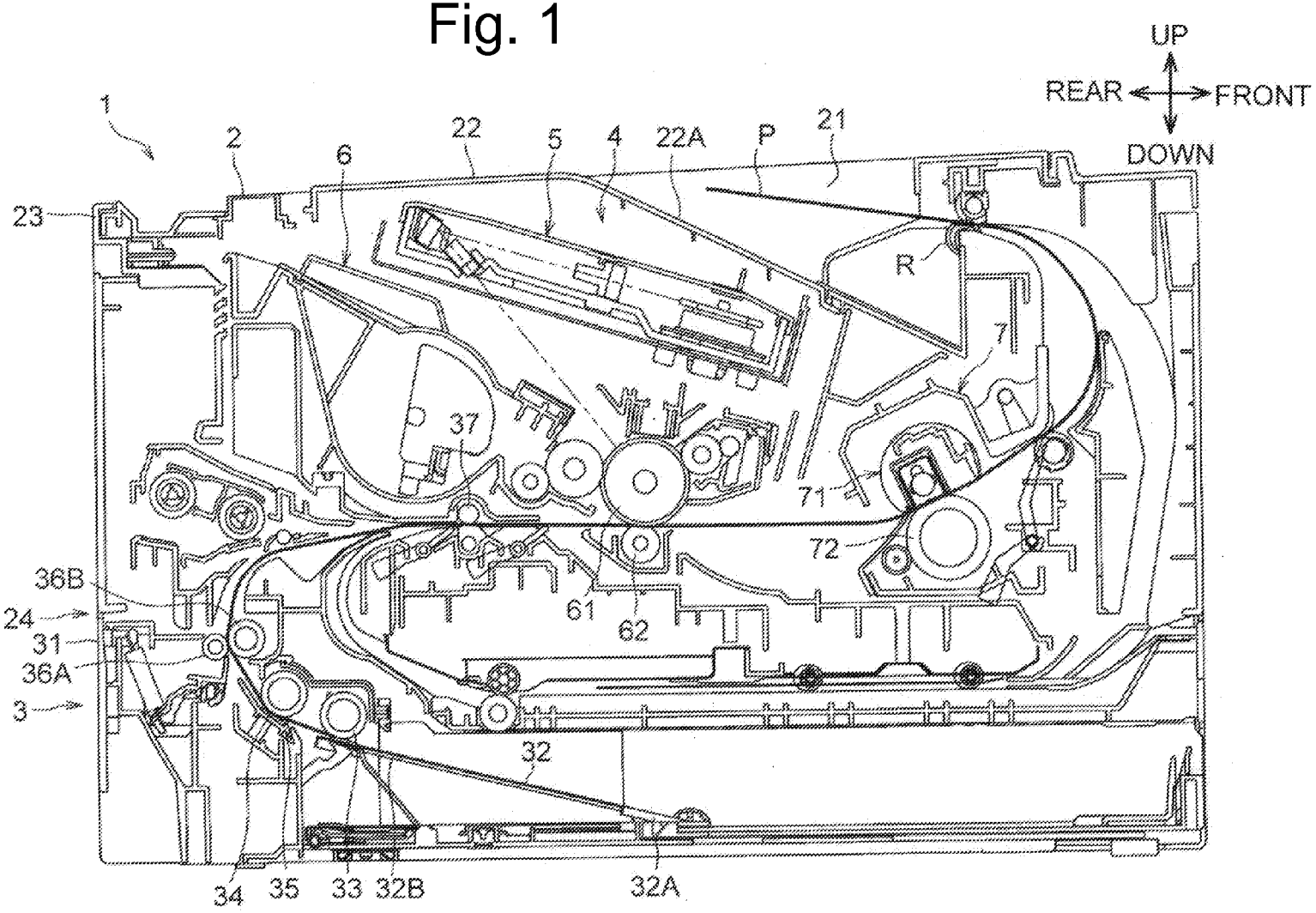
FIG. 1 is a sectional view depicting a laser printer in an illustrative embodiment according to one or more aspects of the disclosure.

In the description below, orientations of a laser printer 1 may be defined with reference to an orientation of the laser printer 1 that may be disposed in which it may be intended to be used. In FIG. 1, the left side of the drawing sheet may be defined as the front of the laser printer 1, the right side of the drawing sheet may be defined as the rear of the laser printer 1, the far side of the drawing sheet may be defined as the left of the laser printer 1, and the near side of the drawing sheet may be defined as the right of the laser printer 1. An up-down direction may be defined with reference to an up-down direction of the drawing sheet when facing the drawing sheet.

As depicted in FIG. 1, the laser printer 1 may comprise a main body 2 as an example of a main body of the disclosure, a feeding unit 3, and an image forming unit 4. The feeding unit 3 may be configured to feed one or more sheets P to the image forming unit 4. The image forming unit 4 may be configured to form an image onto the fed sheet P.

The main body 2 may comprise a pair of body frames (e.g., right and left body frames 21), an upper panel 22, and a front cover 23. The upper panel 22 may be configured to connect upper portions of the right and left body frames 21 with each other. The front cover 23 may be configured to be pivotable with respect to the body frames 21. The upper panel 22 may define a sheet discharge tray 22A that may be configured to receive the one or more sheets P discharged out of the main body 2. The main body 2 may have an opening 24 defined in a lower front part thereof. The opening 24 may open outward and be configured to allow a sheet feed tray 31 to be attached to or removed from the main body 2 therethrough. The opening 24 may be an example of a second opening of the disclosure.

The feeding unit 3 may comprise the sheet feed tray 31 and a pressing plate 32. As described above, the sheet feed tray 31 may be disposed in the lower part of the main body 2 and configured to be attachable and removable with respect to the main body 2 from the front of the main body 2. The pressing plate 32 may be disposed in the sheet feed tray 31. The feeding unit 3 may further comprise a pickup roller 33 and a sheet separating roller 34. The pickup roller 33 may be an example of a first roller of the disclosure and the sheet separating roller 34 may be an example of a second roller of the disclosure. A structure of surroundings of the pickup roller 33 will be described in further detail below.

The pickup roller 33 may be disposed above a sheet holding area of the sheet feed tray 31 (e.g., above a leading edge of an uppermost sheet P in a stack loaded in the sheet feed tray 31). The sheet separating roller 34 may be disposed downstream of the pickup roller 33 with respect to a conveying direction of the sheet P. A sheet separating pad 35 may be disposed diagonally below and in front of the sheet separating roller 34. The sheet separating pad 35 may be configured to pinch the sheet P in cooperation with the sheet separating roller 34 to separate a sheet P one by one from the stack.

The pressing plate 32 may be configured such that its front end 32B may move up and down while its rear end 32A may be pivotably held by a bottom wall of the sheet feed tray 31. With this configuration, the pressing plate 32 may be configured to urge the one or more sheets P placed in the sheet feed tray 31 toward the pickup roller 33. The feeding unit 3 may further comprise a paper dust removing roller 36A, a conveyor roller 36B, and a registration roller pair 37. The paper dust removing roller 36A may be disposed downstream of the sheet separating roller 34 with respect to the conveying direction. The conveyor roller 36B may be disposed to face the paper dust removing roller 36A. The registration roller pair 37 may be disposed downstream of the paper dust removing roller 36A with respect to the conveying direction.

The sheet feed tray 31 may be held by the body frames 21 so as to be attachable to and removable from the main body 2 along a front-rear direction. While the pickup roller 33, the sheet separating roller 34, and the conveyor roller 36B may be held by the main body 2, the sheet separating pad 35 and the paper dust removing roller 36A may be held by the sheet feed tray 31. Therefore, when the sheet feed tray 31 is removed from the main body 2, a contact between the sheet separating roller 34 and the sheet separating pad 35 and a contact between the paper dust removing roller 36A and the conveyor roller 36B may be released and the sheet separating roller 34 may be exposed to the outside of the main body 2 via the opening 24.

In the feeding unit 3 configured as described above, the pickup roller 33 may be configured to feed one or more sheets P placed in the sheet feed tray 31, and the sheet separating roller 34 and the sheet separating pad 35 may be configured to separate the sheet P one by one. After that, the rollers 36A to 37 may be configured to convey the sheet P to the image forming unit 4.

The image forming unit 4 may comprise a scanning unit 5, a process cartridge 6, and a fixing unit 7.

The scanning unit 5 may be disposed in an upper part of the main body 2. The scanning unit 5 may comprise a laser emitting portion (not depicted), a polygon mirror, lenses, and reflectors (whose reference numerals are omitted in FIG. 1). In the scanning unit 5, laser beams may be irradiated onto a surface of a photosensitive drum 61 in high-speed scanning.

The process cartridge 6 may be configured to be attachable and removable with respect to the main body 2 via an opening defined by opening of the front cover 23. The process cartridge 6 may comprise the photosensitive drum 61, a transfer roller 62, a charger, a developing roller, a layer-thickness regulating blade, and a toner chamber (whose reference numerals are omitted in FIG. 1).

In the process cartridge 6, the charger may be configured to uniformly charge the surface of the rotating photosensitive drum 61. After charging, the surface of the rotating photosensitive drum 61 may be exposed by the laser beams irradiated by the scanning unit 5 in the high-speed scanning. Thus, the electric potential of the exposed portion of the surface of the photosensitive drum 61 may be lowered and an electrostatic latent image may be formed on the surface of the photosensitive drum 61.

Then, the developing roller may be configured to supply toner stored in the toner chamber to the electrostatic image formed on the surface of the photosensitive drum 61. After that, a toner image carried by the photosensitive drum 61 may be transferred onto the sheet P while the sheet P passes between the photosensitive drum 61 and the transfer roller 62.

The fixing unit 7 may comprise a heating unit 71 and a pressing roller 72. The heating unit 71 may comprise a halogen heater, a fixing film, and a nip plate (whose reference numerals are omitted in FIG. 1). The pressing roller 72 may be configured to pinch the fixing film between the pressing roller 72 and the nip plate of the heating unit 71. The fixing unit 7 may be configured to fix the toner transferred onto the sheet P by heat while the sheet P passes between the heating unit 71 and the pressing roller 72.

The sheet P on which the toner image has been thermally fixed by the fixing unit 7 may be further conveyed to a discharge roller R and then discharged onto the sheet discharge tray 22A. The discharge roller R may be disposed downstream of the fixing unit 7 with respect to the conveying direction.

The structure of the surroundings of the pickup roller 33 is now described in detail.

Figure 2:
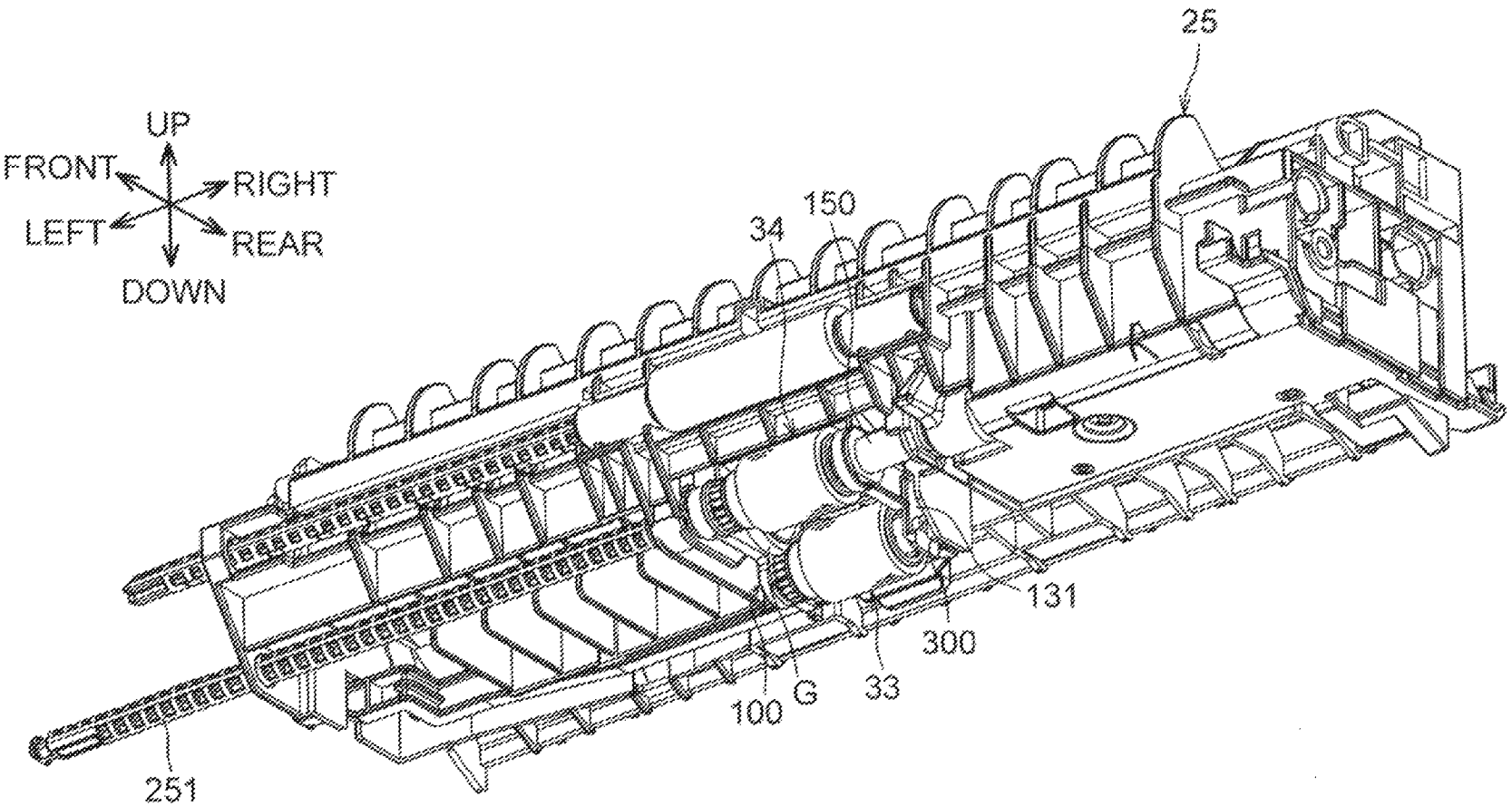
FIG. 2 is a perspective view depicting a structure of surroundings of a pickup roller in the illustrative embodiment according to one or more aspects of the disclosure.
Figure 3:
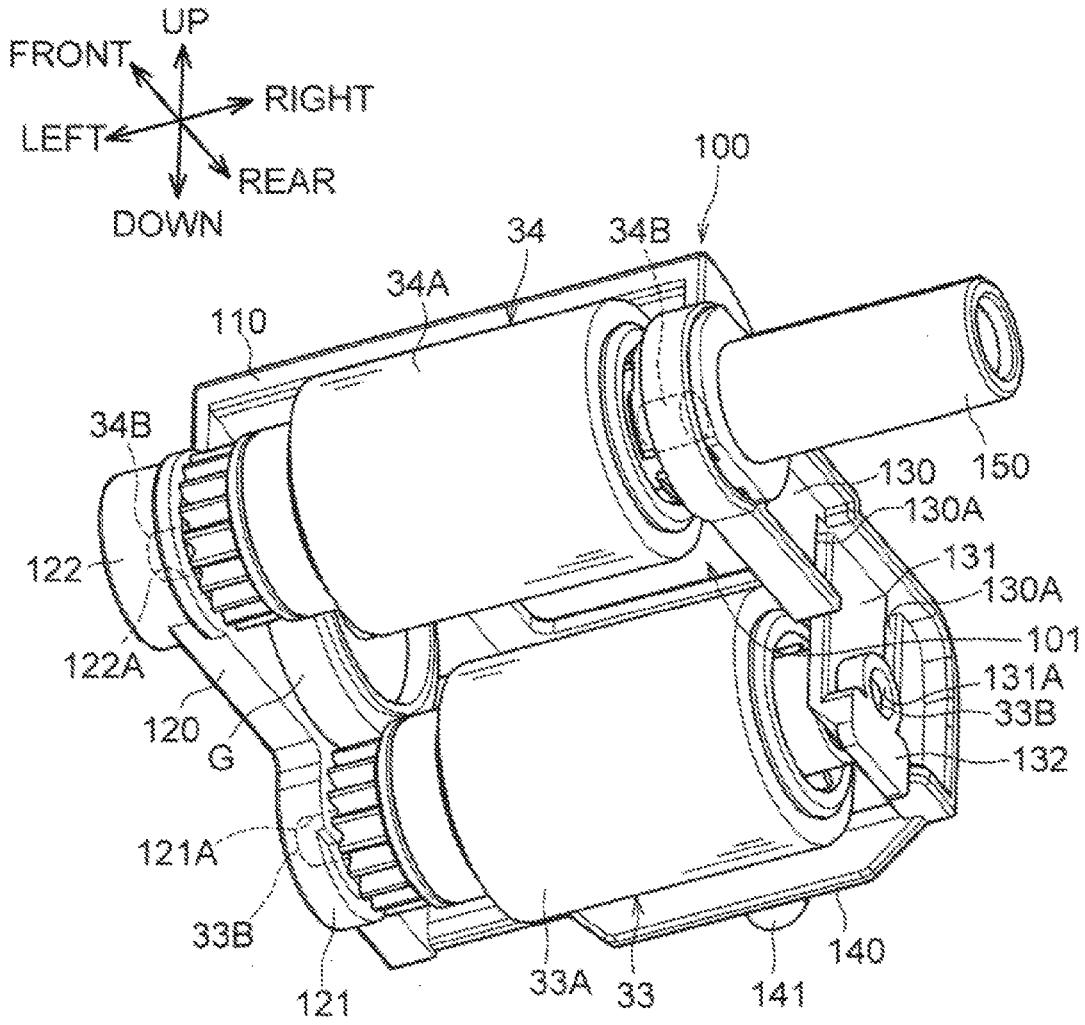
FIG. 3 is a perspective view depicting a roller housing to which the pickup roller and a sheet separating roller are assembled in the illustrative embodiment according to one or more aspects of the disclosure.
Figure 4:
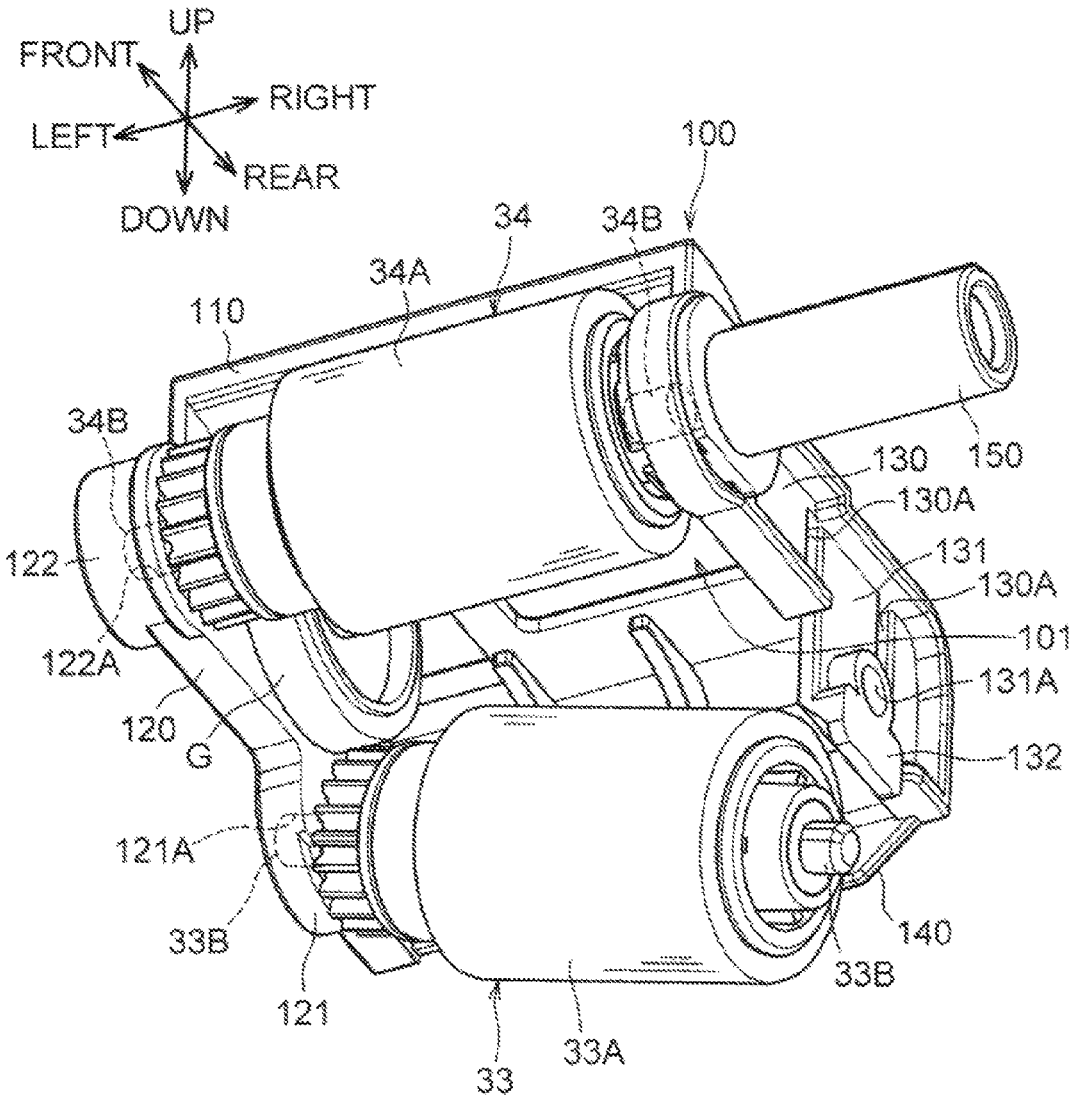
FIG. 4 is a perspective view depicting the roller housing from which the pickup roller is removed in the illustrative embodiment according to one or more aspects of the disclosure.

As depicted in FIGS. 2-4, the pickup roller 33 and the sheet separating roller 34 may be housed in a roller housing 100 that may be an example of a holding member of the disclosure. The roller housing 100 may be configured to be attachable to and removable from a lower housing 25 constituting a lower part of the main body 2.

The pickup roller 33 may be configured to rotate about an axis extending in a predetermined axial direction. The pickup roller 33 may comprise a cylindrical roller portion 33A and shafts 33B that may be examples of a first shaft of the disclosure. The roller portion 33A may be configured to come into pressure contact with the sheet P. The shafts 33B may extend outward from respective ends of the roller portion 33A along the axial direction. Likewise, the sheet separating roller 34 may comprise a cylindrical roller portion 34A and shafts 34B. The roller portion 34A may be configured to come into pressure contact with the sheet P. The shafts 34B may extend outward from respective ends of the roller portion 34A along the axial direction.

A peripheral surface of the roller portion 33A of the pickup roller 33 may be made of material that may be different from material used for a peripheral surface of the roller portion 34A of the sheet separating roller 34. For example, in this illustrative embodiment, the peripheral surface of the roller portion 33A of the pickup roller 33 may be made of material that may be softer than the material used for the peripheral surface of the roller portion 34A of the sheet separating roller 34. The peripheral surface of the roller portion 33A of the pickup roller 33 may wear easier than the peripheral surface of the roller portion 34A of the sheet separating roller 34.

In one or more arrangements, the roller housing 100 may be made of resin material. The roller housing 100 may have a monolithic structure that may comprise an upper wall portion 110, a left wall portion 120, a right wall portion 130, and a rear wall portion 140. The upper wall portion 110 may be located in an upper position while the roller housing 100 is attached to the lower housing 25. The left and right wall portions 120 and 130 may extend downward from left and right ends, respectively, of the upper wall portion 110. The rear wall portion 140 may connect the upper wall portion 110, the left wall portion 120, and the right wall portion 130 with each other. The roller housing 100 may have an opening 101 that may allow the pickup rollers 33 and the sheet separating roller 34 to be exposed forward and downward. The opening 101 may be an example of a third opening of the disclosure.

A rearward part of the left wall portion 120 may serve as a first bearing portion 121 having a bearing opening 121A. The first bearing portion 121 may be an example of a first supporting portion of the disclosure. The bearing opening 121A may be configured to hold therein the left shaft 33B of the pickup roller 33. A forward part of the left wall portion 120 may serve as a second bearing portion 122 having a bearing opening 122A. The second bearing portion 122 may be an example of a third supporting portion of the disclosure. The bearing opening 122A may be configured to hold therein the left shaft 34B of the sheet separating roller 34. The right wall portion 130 may comprise a first bearing portion 131 at a rearward part thereof. The first bearing portion 131 may be an example of the first supporting portion of the disclosure. The first bearing portion 131 may have a bearing opening 131A. The bearing opening 131A may be configured to hold therein the right shaft 33B of the pickup roller 33.

The right wall portion 130 may have slits 130A that may define the first bearing portion 131 in front of and in back of the first bearing portion 131. Each slit 130A may extend along the up-down direction and have a lower open end. Therefore, the first bearing portion 131 may have a plate-like shape that may be downwardly elongated along the up-down direction from the upper wall portion 110. With this configuration, the first bearing portion 131 that may be integral with a main body of the roller housing 100 may be configured to be elastically deformable with respect to the axial direction.

Figure 5:
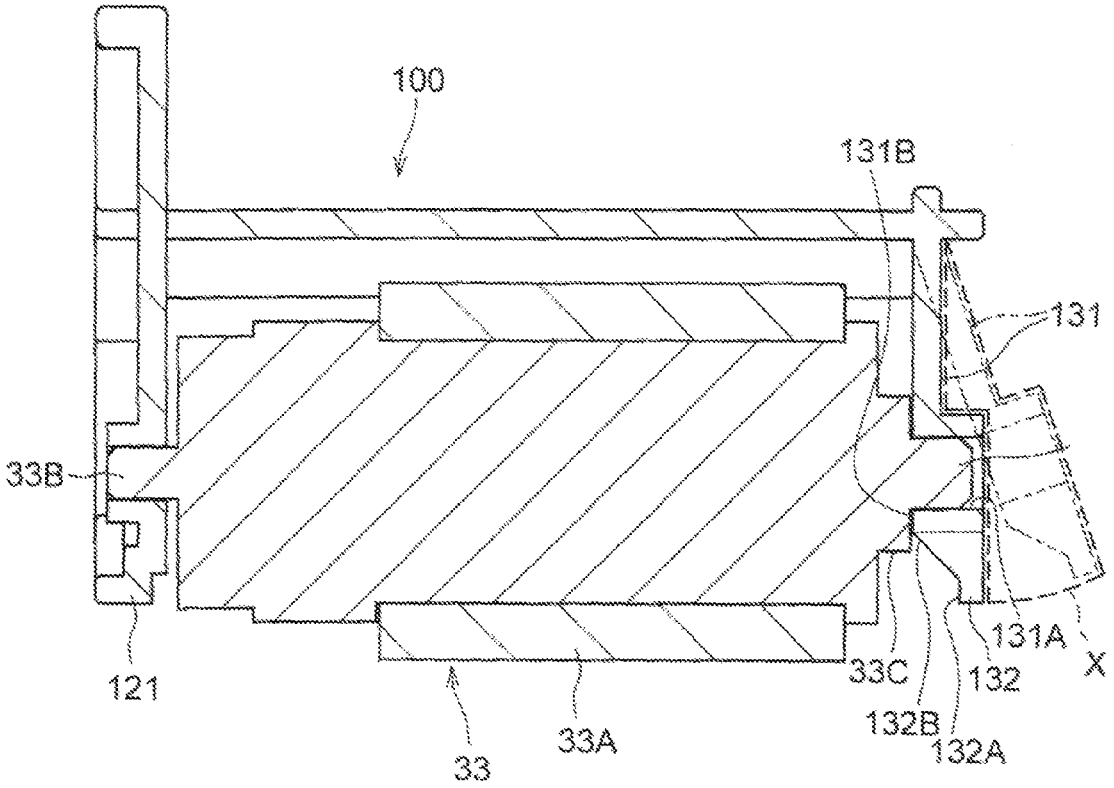
FIG. 5 is a sectional view simply depicting the pickup roller and a first bearing portion in the illustrative embodiment according to one or more aspects of the disclosure.

More specifically, as simply depicted in FIG. 5, the first bearing portion 131 may be configured to be movable within a movable range X (indicated by a dashed line) between a first position (indicated by a solid line) and a second position (indicated by a double-dotted and dashed line). In the first position, the first bearing portion 131 may be configured to hold the right shaft 33B of the pickup roller 33. In the second position, the first bearing portion 131 may be located outside of and adjacent to an end of the right shaft 33B of the pickup roller 33 with respect to the axial direction while being disengaged from the shaft 33B of the pickup roller 33. With this configuration, as depicted in FIGS. 3 and 4, when the roller housing 100 is separated from the lower housing 25, the first bearing portion 131 may be deformed outward with respect to the axial direction. By doing so, the pickup roller 33 may be replaced with a new one while the sheet separating roller 34 remains in the roller housing 100.

The first bearing portion 131 may further comprise a protrusion 132 that may protrude downward (outward in a diameter direction of the shaft 33B) from a vicinity of the bearing opening 131A of the first bearing portion 131. More specifically, as depicted in FIG. 5, the protrusion 132 may protrude outward in the diameter direction beyond a peripheral surface 33C of a portion, which may be located facing an inner surface of the first bearing portion 131, of the pickup roller 33 with respect to the axial direction. With this configuration, when a user hooks his/her finger on the protrusion 132 from an inner-surface side of the first bearing portion 131 with respect to the axial direction, the peripheral surface 33C of the portion of the pickup roller 33 may be out of the path of the user's finger. Therefore, the user may readily deform the first bearing portion 131.

In the illustrative embodiment, the protrusion 132 may comprise inner surfaces 132A and 132B. The inner surface 132A may be disposed at a free-end side. The inner surface 132B may be disposed at a base-end side of the protrusion 132 (e.g., a side or portion of the protrusion 132 closer to the fixed end of first bearing portion 131). The inner surface 132A may be located in a position outside of the inner surface 132B with respect to the axial direction. More specifically, the inner surface consisting of the inner surfaces 132A and 132B of the protrusion 132 may be inclined toward the outside with respect to the diameter direction and the axial direction and bent to extend downward at a portion located at the free-end side of the protrusion 132.

In one arrangement, in the protrusion 132, the inner surface 132A may be located in the position outside of the inner surface 131B that may serve as a part of a periphery of the bearing opening 131A with respect to the axial direction. With this configuration, a larger space may be left between the pickup roller 33 and the inner surface of the protrusion 132 with respect to the axial direction. Thus, this configuration may allow the user to more easily insert his/her finger into the space and improve operability of the first bearing portion 131.

As depicted in FIGS. 3 and 4, the right wall portion 130 may further comprise a bearing member 150 at its forward part. The bearing member 150 may be an example of a second supporting portion of the disclosure. The bearing member 150 may be configured to be attachable to and removable from the roller housing 100 and hold the right shaft 34B of the sheet separating roller 34. Therefore, the sheet separating roller 34 may be replaced by removing the bearing member 150 from the roller housing 100 while the pickup roller 33 remains in the roller housing 100.

As depicted in FIG. 2, the left shaft 34B of the sheet separating roller 34 may be configured to be connected to a drive shaft 251 that may be rotatably disposed in the lower housing 25, and the bearing member 150 may be held by the lower housing 25. This configuration may allow the roller housing 100 to pivot about the shafts 34B. For example, the roller housing 100 may be held by the lower housing 25 such that the roller housing 100 may be pivotable about an axis extending parallel to a direction in which the shafts 33B of the pickup roller 33 may extend and be spaced forward (in the diameter direction) from the shafts 33B.

As described above, the left shaft 34B of the sheet separating roller 34 may be configured to be connected with the drive shaft 251. Therefore, the sheet separating roller 34 may be configured to be rotated by a driving force transmitted from a motor (not depicted) disposed in the main body 2 via the drive shaft 251. The pickup roller 33 may be configured to be rotated by the driving force further transmitted from the sheet separating roller 34 via a gear G rotatably disposed in the roller housing 100.

Figure 6:
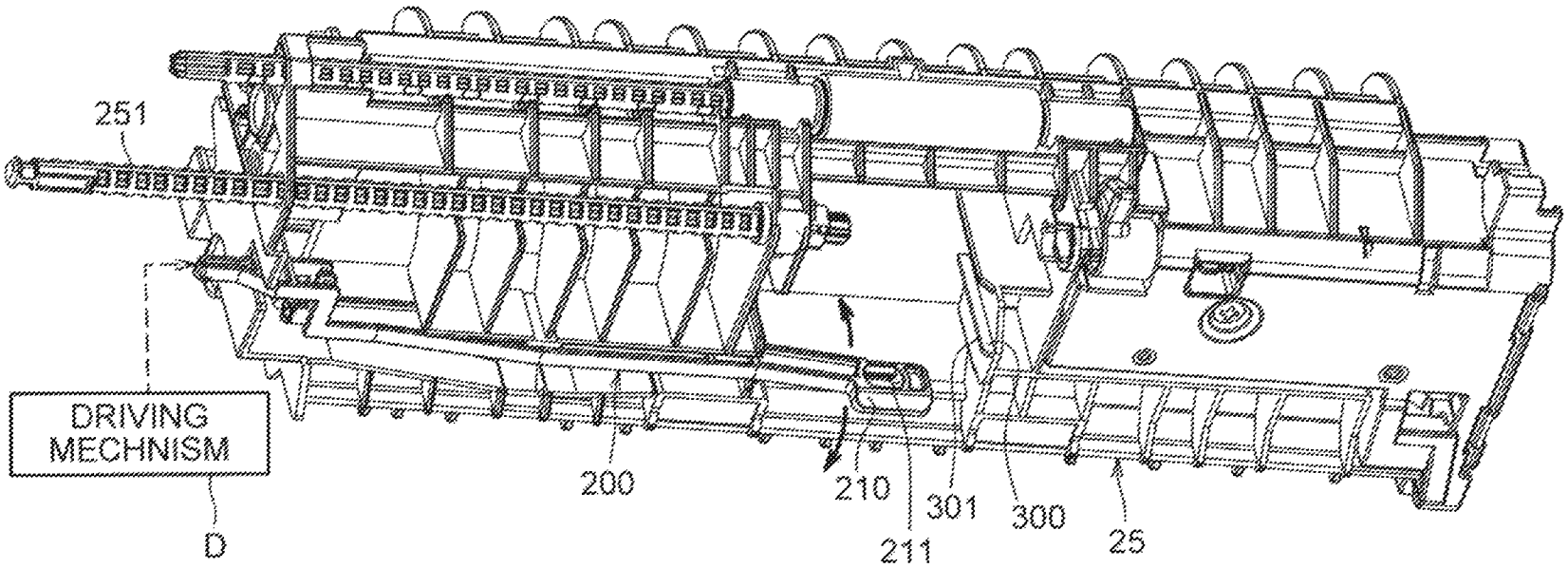
FIG. 6 is a perspective view of a lower housing from which the roller housing is removed in the illustrative embodiment according to one or more aspects of the disclosure.

As depicted in FIG. 3, the rear wall portion 140 may include an engaging projection 141 that may protrude rearward from the rear wall portion 140. The engaging projection 141 may be an example of an engaging portion of the disclosure. The engaging projection 141 may be configured to be engageable and disengageable with respect to an engagement opening 211 defined in one end portion 210 of a swing arm 200 constituting the main body 2, as depicted in FIGS. 6 to 7C.

The swing arm 200 may be held by the lower housing 25 such that its substantially middle part may be swingable. The swing arm 200 may be configured such that the one end portion 210 may be movable up and down which may thereby cause the other end portion of the swing arm 200 to move up and down by a driving mechanism D, as depicted in FIG. 6. With this configuration, the roller housing 100 may be configured to swing between a sheet feeding position depicted in FIG. 7A and a separated position depicted in FIG. 7B. The sheet feeding position may be an example of a third position of the disclosure and the separated position may be an example of a fifth position of the disclosure. In one example, the engaging projection 141 may be configured to be in engagement with the one end portion 210 of the swing arm 200 while the roller housing 100 swings between the sheet feeding position and the separated position.

When the engaging projection 141 is disengaged from the one end portion 210 of the swing arm 200, the roller housing 100 may be configured to be swung by gravitation to a disengaged position (see FIG. 7C) that may be an example of a fourth position of the disclosure. The disengaged position may be spaced apart from the sheet feeding position and located below the sheet feeding position (with respect to the diameter direction perpendicular to the axial direction). The separated position may be located on an opposite side of the disengaged position with respect to the sheet feeding position.

Figure 7A:
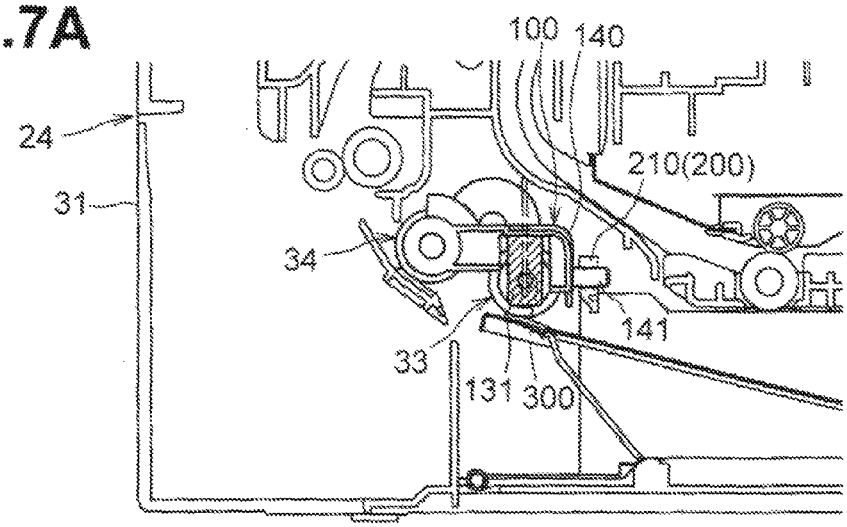
FIG. 7A is a sectional view depicting the roller housing that is located in a sheet feeding position in the illustrative embodiment according to one or more aspects of the disclosure.
Figure 7B:
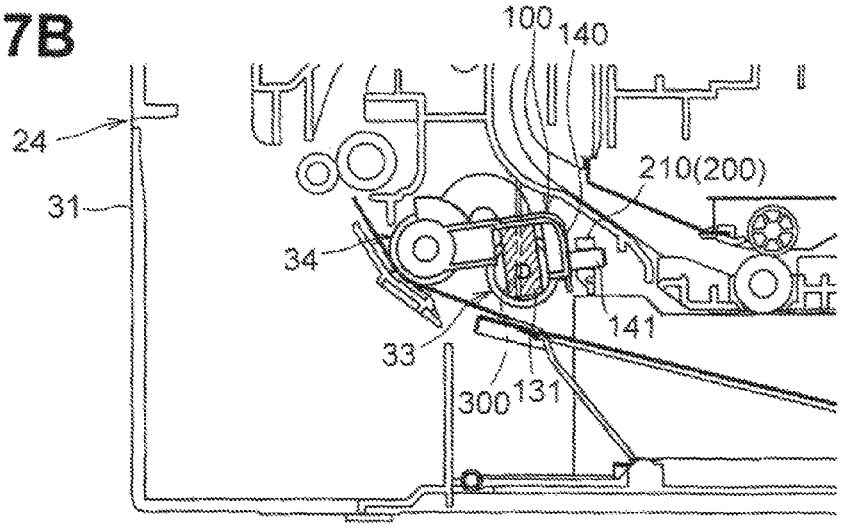
FIG. 7B is a sectional view depicting the roller housing that is located in a separated position in the illustrative embodiment according to one or more aspects of the disclosure.
Figure 7C:
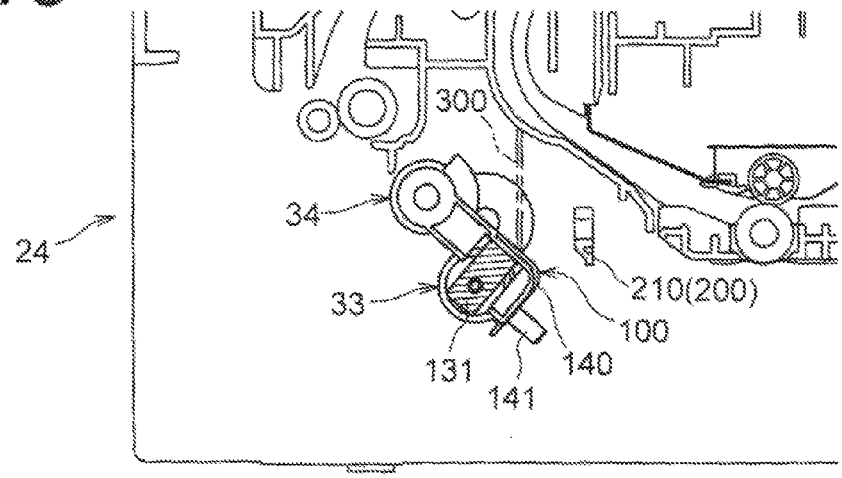
FIG. 7C is a sectional view depicting the roller housing located in a disengaged position in the illustrative embodiment according to one or more aspects of the disclosure.
Figure 8:
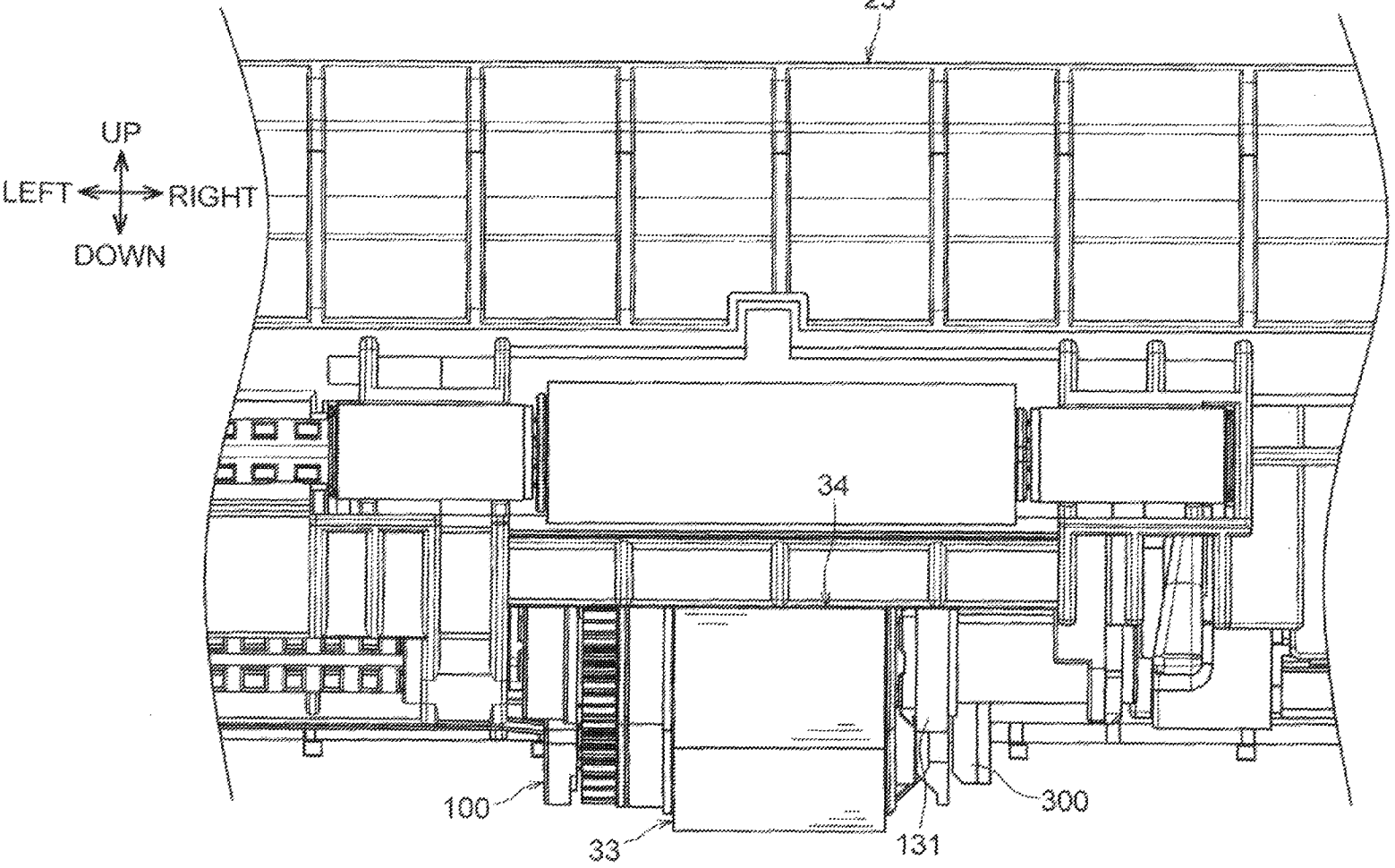
FIG. 8 is a front view depicting the lower housing in the illustrative embodiment according to one or more aspects of the disclosure.

As depicted in FIGS. 7A to 8, the lower housing 25 may comprise a regulating portion 300 that may be an example of a regulating member of the disclosure. The regulating portion 300 may be configured to face the first bearing portion 131 of the roller housing 100 with respect to the axial direction and restrict the outward movement of the first bearing portion 131 with respect to the axial direction while the roller housing 100 swings between the sheet feeding position and the separated position, e.g., while the roller housing 100 is attached to the lower housing 25 in a state where the pickup roller 33 and the sheet separating roller 34 may operate to pick up and separate individual sheets from the sheet tray.

More specifically, the regulating portion 300 may be positioned within the movable range X of the first bearing portion 131 while the roller housing 100 is present in an area between the sheet feeding position and the separated position. As depicted in FIGS. 7A, 7B, 9A, and 9B, the regulating portion 300 may be configured to be disposed within the movable range X and may be movable up and down in accordance with the swinging of the roller housing 100. For example, the regulating portion 300 may extend in the up-down direction along the moving path of the first bearing portion 131 that may be movable up and down between the sheet feeding position and the separated position.

Figure 13A:
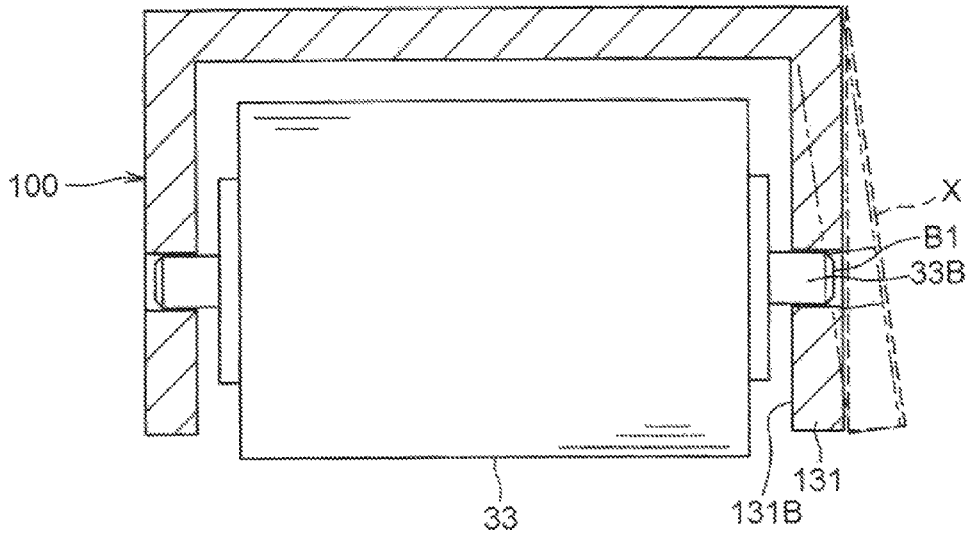
FIGS. 13A, 13B and 13C are sectional views depicting a relationship between a first bearing portion and a regulating portion according to one or more aspects of the disclosure.
Figure 13B:
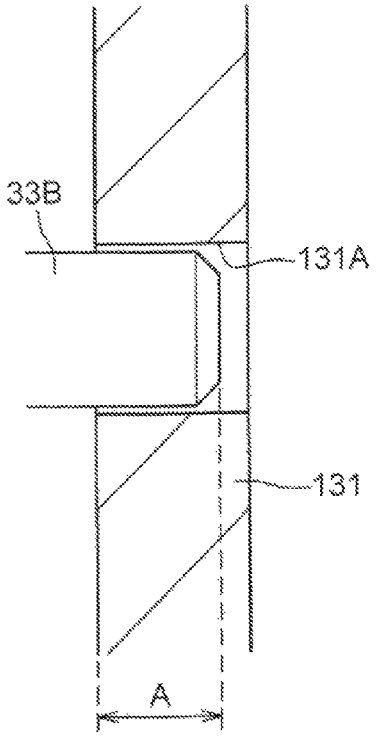
Figure 13C:
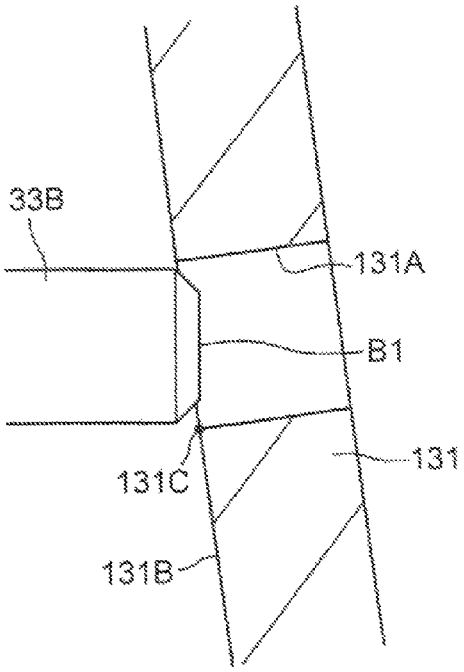
Figure 14A:
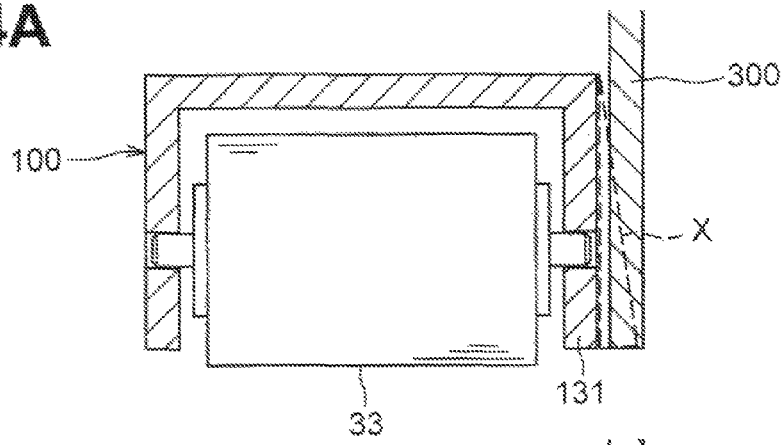
FIGS. 14A-14C are sectional views depicting various positions of the regulating portion of FIGS. 13A-13C relative to the first bearing portion according to one or more aspects of the disclosure.

In one example arrangement, as shown in FIGS. 13A-13C and 14A-14C, the movable range X may correspond to a distance A (e.g., in the axial direction) of a portion of shaft 33B. For example, the length may be defined from a portion of the shaft 33B located at a same axial position as an interior surface 131B of the first bearing portion 131 (when the shaft 33B is in the engaged state with the first bearing portion 131 as shown in FIG. 14A) to an end surface B1 of the shaft 33B. The first bearing portion 131 may be configured to move such that the bearing opening 131A is movable an axial distance equal to distance A, as shown in FIGS. 13A-13C. The moveable range X may also be defined as a movement range extending from a position of the first bearing portion 131 where the shaft 33B is fully engaged to another position where the shaft 33B initially becomes disengaged or removed from bearing portion 131. For example, the shaft 33B may initially become disengaged or removed from bearing portion 131 when a surface of the bearing portion 131 facing the roller 33 in the axial direction is located at the end surface B1 of the shaft 33B.

Figure 14B:
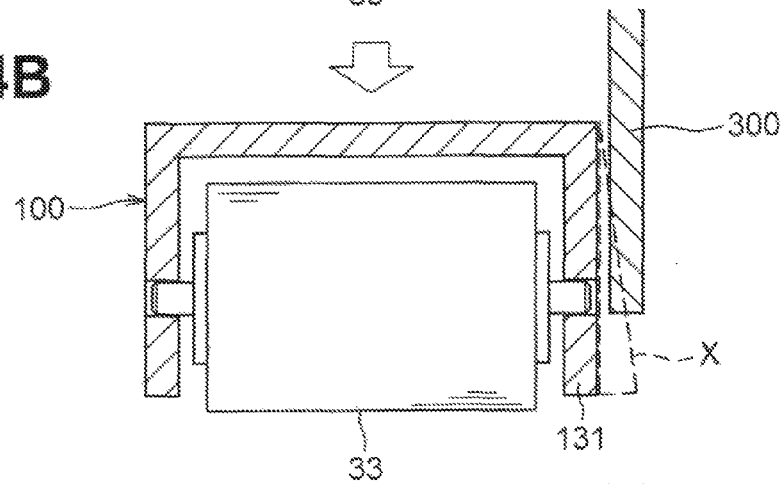

The regulating portion 300 may then be positioned with at least a portion thereof located within the moveable range X. FIGS. 14A and 14B illustrate example configurations where the regulating portion 300 is positioned with at least a portion in the moveable range X.

Figure 14C:
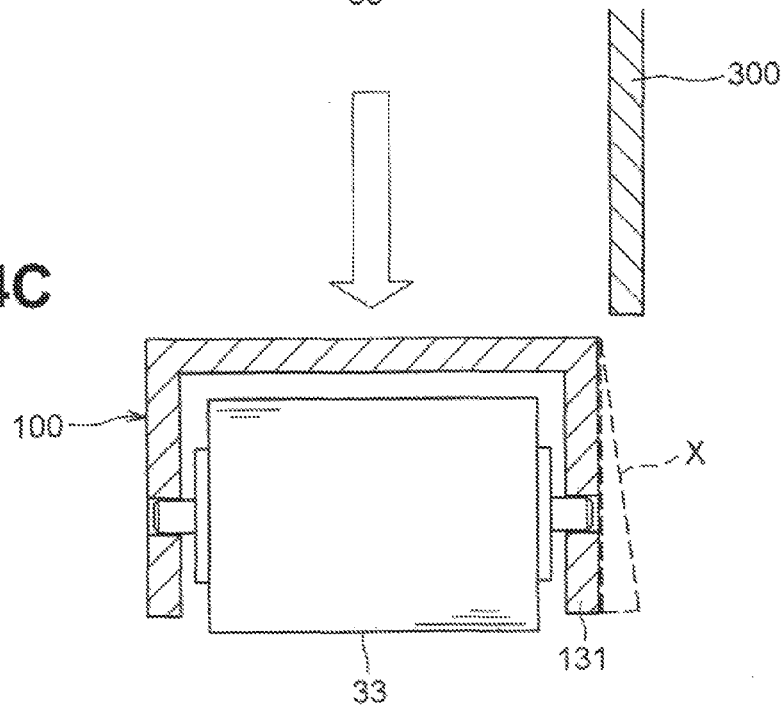

With this configuration, while the roller housing 100 is disposed within the area between the sheet feeding position and the separated position, e.g., while the roller housing 100 is attached to the lower housing 25, the regulating portion 300 may restrict the movement of the first bearing portion 131. Therefore, this configuration may reduce undesired disengagement of the pickup roller 33 from the roller housing 100 that may be caused by the user who may touch the pickup roller 33 by mistake while the roller housing 100 is attached to the lower housing 25. Further, as described above, the regulating portion 300 may extend along the moving path of the first bearing portion 131. Therefore, this configuration may reduce undesired catching of the first bearing portion 131 on the regulating portion 300 while the roller housing 100 swings between the sheet feeding position and the separated position. FIG. 14C illustrates an example configuration where regulating portion 300 is positioned outside of moveable range X, thus allowing for full movement of first bearing portion 131 over moveable range X and allowing for disengagement of shaft 33B of roller 33.

In the illustrative embodiment of FIG. 6, the regulating portion 300 may comprise a surface 301 that may face the first bearing portion 131. The surface 301 may extend in the same plane with respect to the axial direction from its upper end to its lower end. For example, the surface 301 may be a flat surface. Therefore, when the first bearing portion 131 swings from the sheet feeding position to the separated position, this configuration may reduce the undesired catching of the first bearing portion 131 on the surface 301.

Figure 9A:
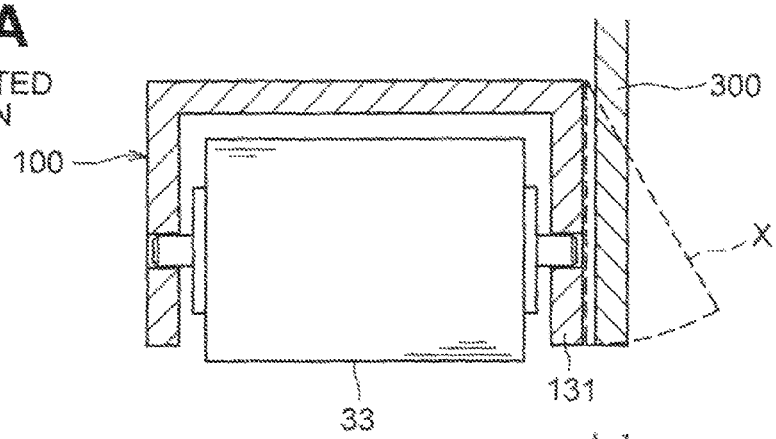
FIGS. 9A-9C are sectional views simply depicting a relationship between a movable range of the first bearing portion and a regulating portion in the illustrative embodiment according to one or more aspects of the disclosure.
Figure 9B:
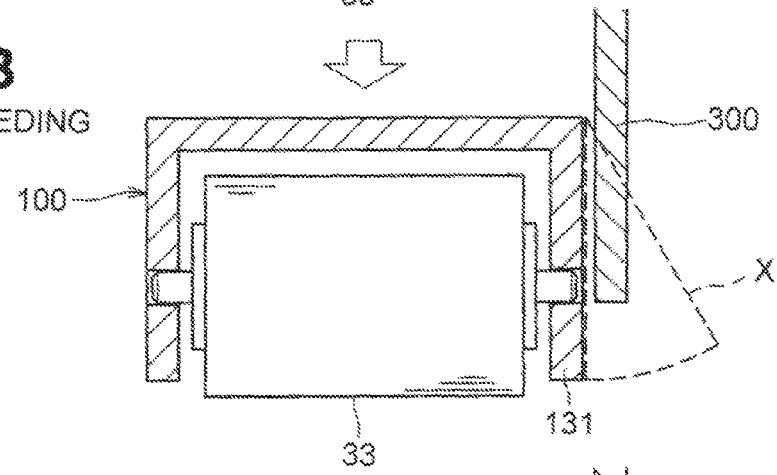
Figure 9C:
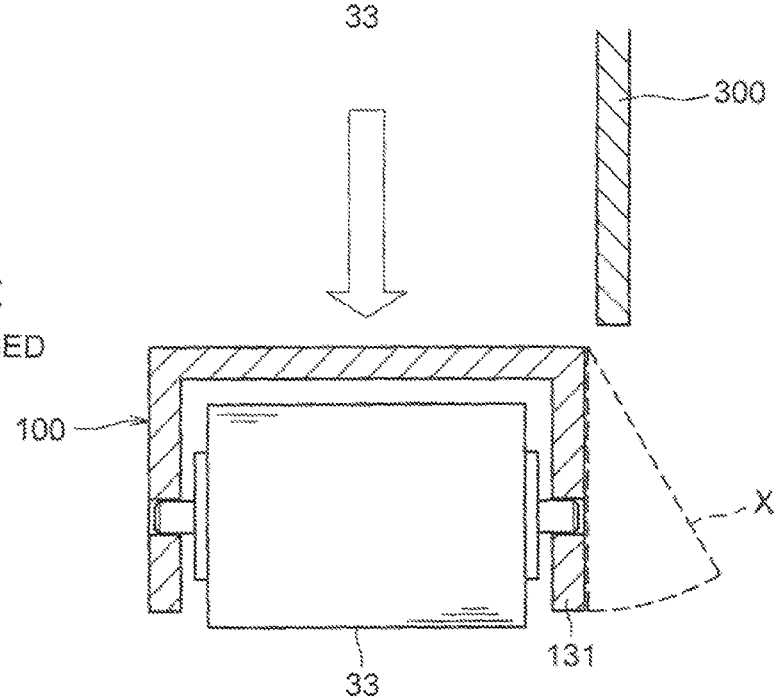

As shown in FIGS. 7C and 9C, the regulating portion 300 may be configured to be positioned out of the movable range X and to allow the first bearing portion 131 to move outward with respect to the axial direction when the roller housing 100 is located in the disengaged position. For example, when the roller housing 100 swings from the sheet feeding position to the disengaged position, the movable range X may be moved downward and thus the regulating portion 300 may be located out of the movable range X.

Thus, when the roller housing 100 is moved to the disengaged position, e.g., when the roller housing 100 is displaced from an attached position (e.g., the sheet feeding position) of the lower housing 25, the first bearing portion 131 may be allowed to be moved. Therefore, the pickup roller 33 may be allowed to be replaced (e.g., with a new or replacement pickup roller) in this state.

In the illustrative embodiment, when the roller housing 100 is located in the disengaged position, substantially an entirety of the pickup roller 33 may face the opening 24 of the main body 2. When the roller housing 100 is located in the sheet feeding position, the pickup roller 33 may be retracted to behind the sheet separating roller 34 from the opening 24, farther than the disengaged position. With this configuration, when the roller housing 100 is located in the disengaged position to attach or remove the pickup roller 33 to or from the roller housing 100, substantially an entirety of the pickup roller 33 may face the opening 24. Accordingly, a person replacing the pickup roller 33, e.g., the user or a service person, may easily access the pickup roller 33 via the opening 24, and thus, easily attach or remove the pickup roller 33 to or from the roller housing 100.

Further, when the roller housing 100 is located in the sheet feeding position, the pickup roller 33 may be located behind the sheet separating roller 34. Therefore, the user may hardly touch the pickup roller 33. Accordingly, this configuration may reduce undesired disengagement of the pickup roller 33 while the roller housing 100 is attached to the lower housing 25.

A process of replacing the pickup roller 33 is now described with reference to FIGS. 10A to 10C.

Figure 10A:
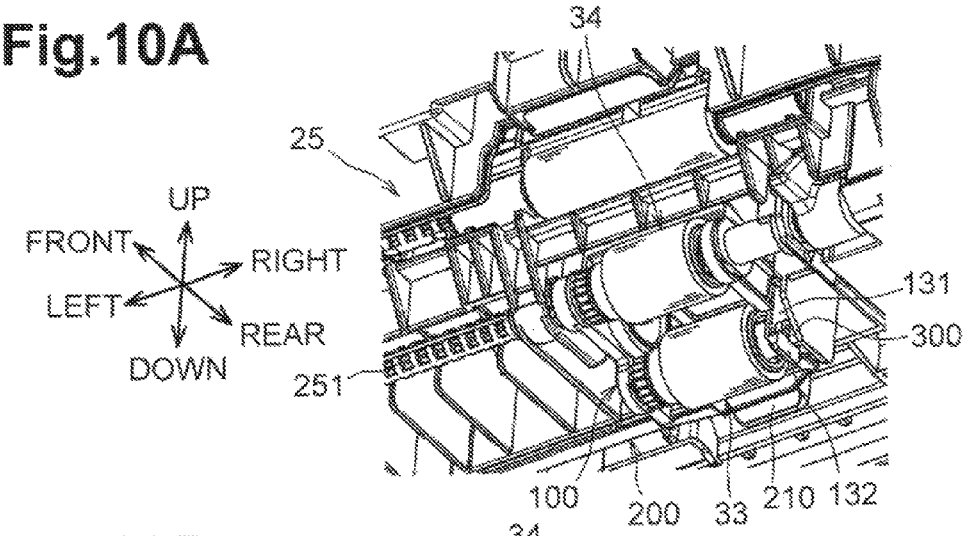
FIG. 10A is a perspective view depicting the roller housing that is located in the sheet feeding position in the illustrative embodiment according to one or more aspects of the disclosure.
Figure 10B:
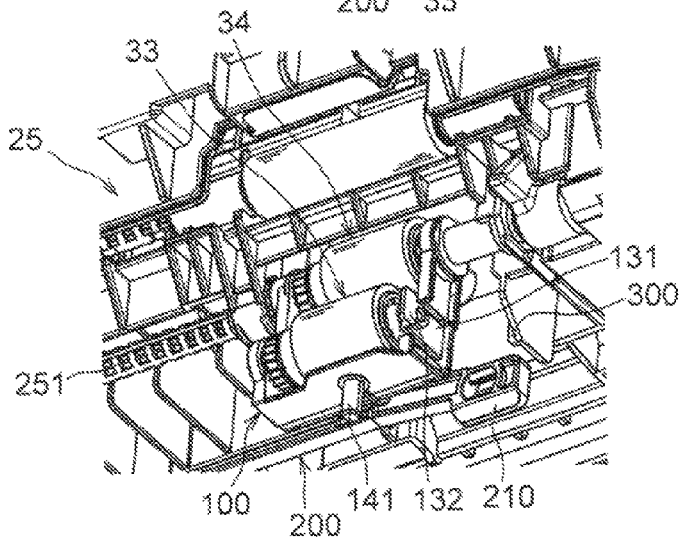
FIG. 10B is a perspective view depicting the roller housing that is located in the disengaged position in the illustrative embodiment according to one or more aspects of the disclosure.

For example, when the pickup roller 33 reaches the end of its life before the sheet separating roller 34 reaches the end of its life, as depicted in FIGS. 10A and 10B, the user may disengage the engaging projection 141 of the roller housing 100 from the one end portion 210 of the swing arm 200 and move the roller housing 100 from the sheet feeding position to the disengaged position.

In this state, the user may hook his/her finger on the protrusion 132 of the first bearing portion 131 to deform the first bearing portion 131 with respect to the axial direction. Then, as depicted in FIG. 4, the first bearing portion 131 may be disengaged from the right shaft 33B of the pickup roller 33 and the pickup roller 33 may be allowed to be removed from the roller housing 100. Subsequently, the user may fit the shafts 33B of a new/replacement pickup roller 33 into the respective first bearing portions 121, 131 while deforming the first bearing portion 131, and then move the roller housing 100 upward to engage the engaging projection 141 with the one end portion 210 of the swing arm 200. Then, the replacing operation of the pickup roller 33 may be completed.

Figure 10C:
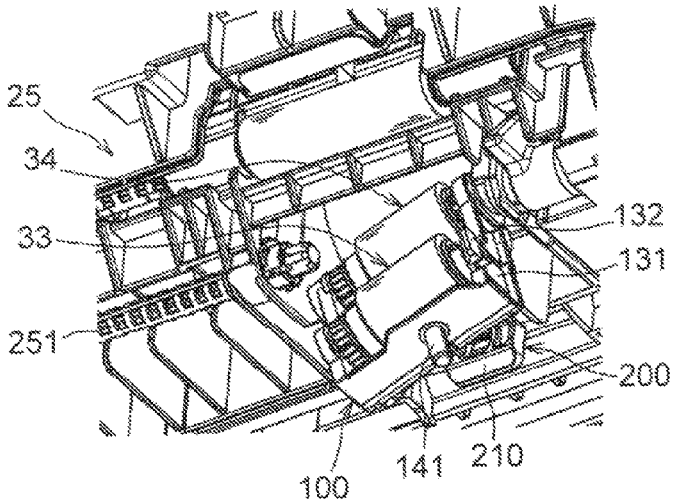
FIG. 10C is a perspective view depicting the roller housing in which the sheet separating roller is disengaged from a drive shaft in the illustrative embodiment according to one or more aspects of the disclosure.

As depicted in FIG. 10C, in the disengaged position, the user may slide the roller housing 100 and rotate the roller housing 100 in a counterclockwise direction to disengage the sheet separating roller 34 from the drive shaft 251. By doing so, the roller housing 100 may be completely removed from the lower housing 25. Therefore, the user may be allowed to replace one or more of the pickup roller 33 and the sheet separating roller 34 by operating the protrusion 132 of the first bearing portion 131 after removing the roller housing 100 completely from the lower housing 25. After completing the replacement of one or more of the pickup roller 33 and the sheet separating roller 34, the user may perform the above-described steps of the replacing operation in the reverse order to attach the roller housing 100 to the lower housing 25 again.

The disclosure may not be limited to the illustrative embodiment described above but may include other features as described below. Hereinafter, an explanation is given mainly for the parts different from the above-described illustrative embodiment, and an explanation is omitted for the common parts by assigning the same reference numerals thereto.

In the above-described illustrative embodiment, the first bearing portion 131 and the roller housing 100 may be integrally formed by resin. In other example embodiments, however, a first bearing member 500, as the first bearing portion of the disclosure, may be separately provided from a roller housing 400, as depicted in FIGS. 11A and 11B.

For example, the first bearing member 500 may have a substantially cylindrical shape and be configured to rotatably hold one of the shafts 33B of the pickup roller 33. The first bearing member 500 may comprise a protrusion 510 that may protrude outward from its peripheral surface with respect to a diameter direction of the first bearing member 500.

The roller housing 400 may comprise a side wall 420 that may face the pickup roller 33 with respect to the axial direction and be an example of the second supporting portion of the disclosure. The side wall 420 may have an opening 410 defined therein to removably hold the first bearing member 500 in the opening 410 with respect to the axial direction. The opening 410 may be an example of the first opening of the disclosure. The first bearing member 500 may be configured to be movable between a first position and a second position. In the first position, the first bearing member 500 may be engaged with the opening 410. In the second position, the first bearing member 500 may be disengaged from the opening 410 with respect to the axial direction.

Figure 11A:
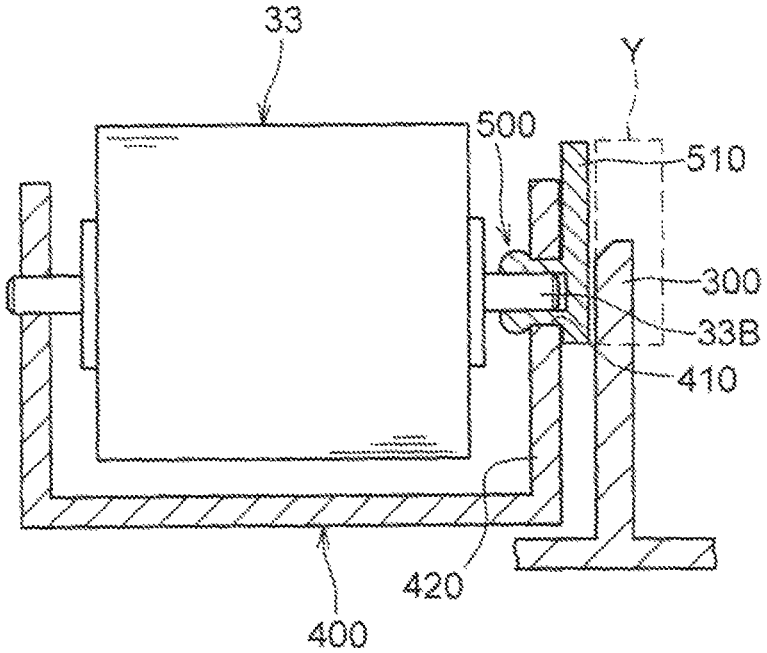
FIGS. 11A and 11B are sectional views simply depicting a first bearing member in a variation of the illustrative embodiment according to one or more aspects of the disclosure.
Figure 11B:
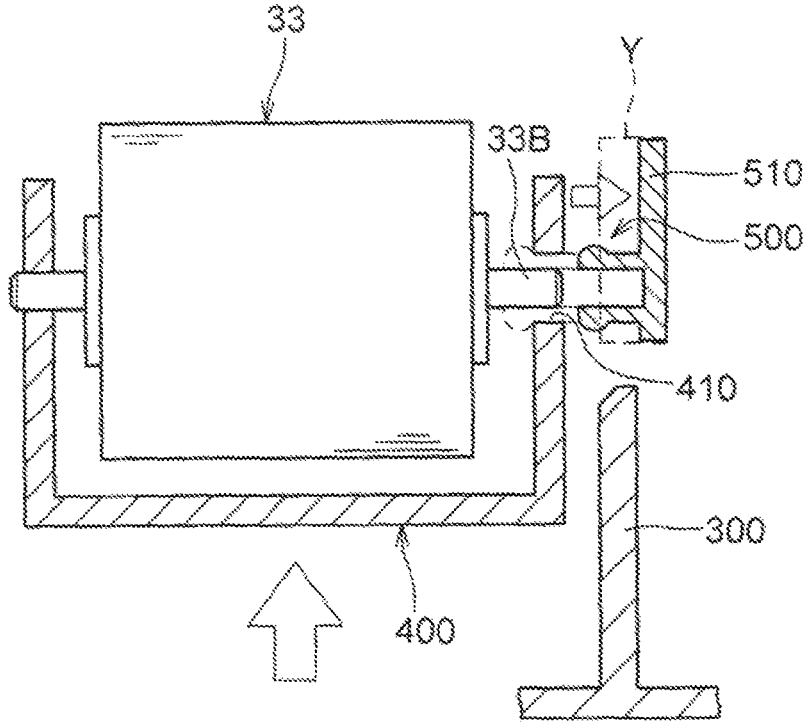
Figure 15A:
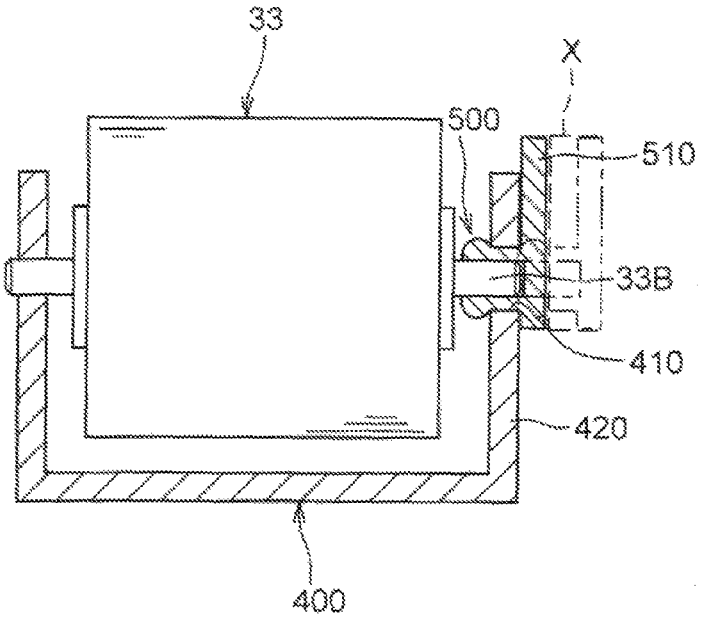
FIGS. 15A, 15B and 15C are sectional views depicting another example relationship between a bearing portion and a regulating portion according to one or more aspects of the disclosure.
Figure 15B:
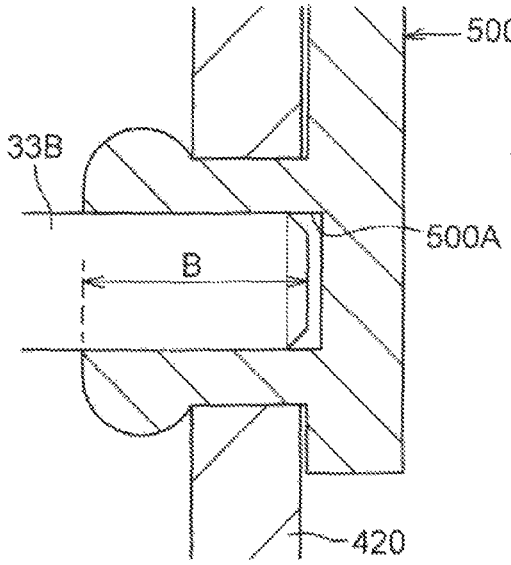
Figure 15C:
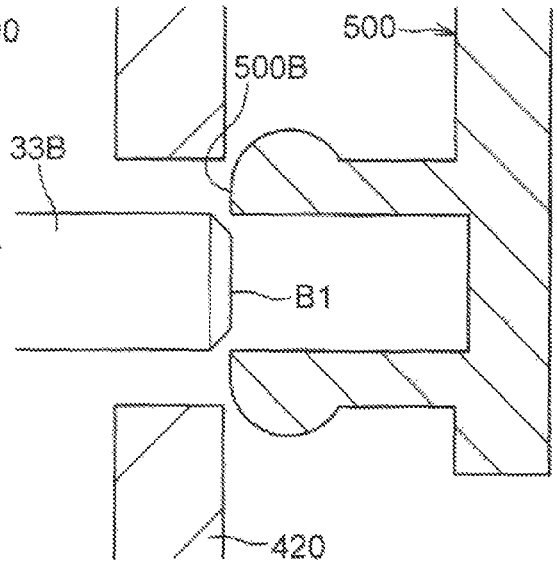
Figure 16A:
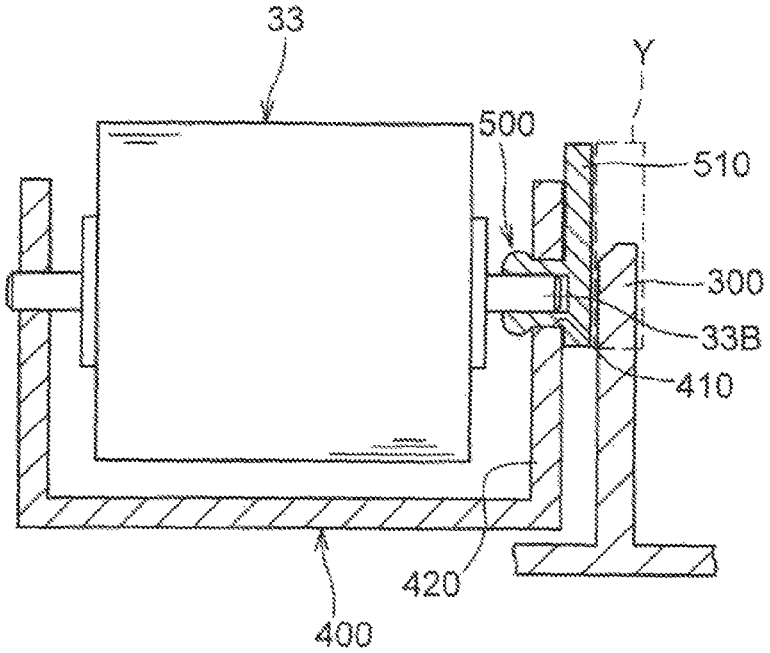
FIGS. 16A and 16B are sectional views depicting various positions of the regulating portion of FIGS. 15A-15C relative to the bearing portion according to one or more aspects of the disclosure.
Figure 16B:
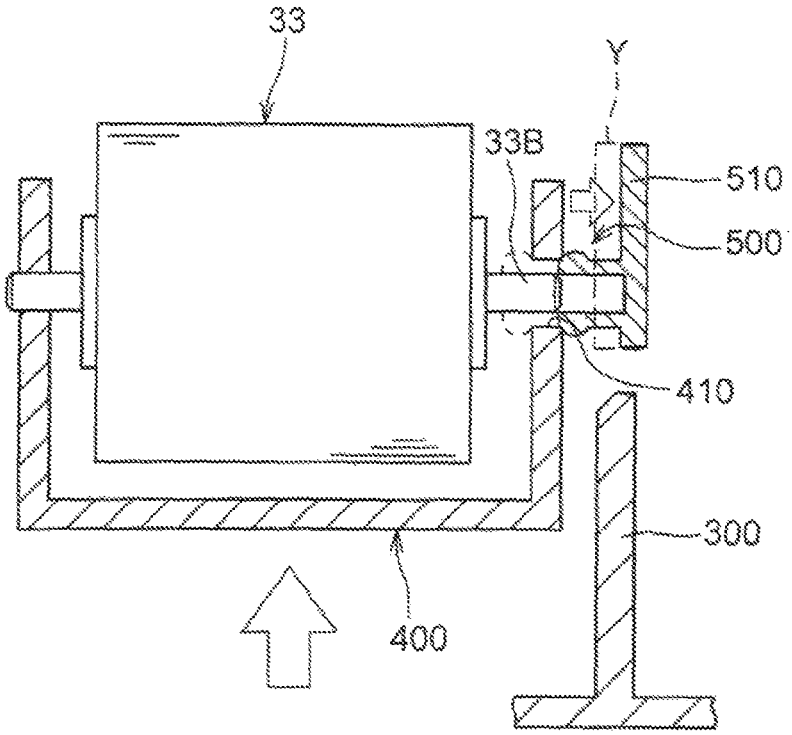

As depicted in FIG. 11A, while the roller housing 400 is attached to the main body 2, at least a portion of the regulating portion 300 may be configured to face (be adjacent to) the first bearing member 500 within a movable range Y of the first bearing member 500 with respect to the axial direction. For example, and as shown in FIG. 16, the movable range Y may be defined by an axial distance B extending from an end surface 500B of the first bearing member 500 to an end surface B1 of the shaft 33B when the shaft 33B is in an inserted portion as shown in FIGS. 15A-15C. The distance B may correspond to a length of a portion of the shaft 33B inserted in the opening 500A of the first bearing member 500. The first bearing portion 500 may be configured to move such that the first bearing member 500 is axially movable distance B. The movable range Y may also be defined as extending from a first position of first bearing portion 500, when the first bearing portion 500 is engaged with the shaft 33B (e.g., a portion of the shaft 33B is inserted into the opening 500A as shown in FIG. 16A), to a second position of first bearing portion 500, when the first bearing portion 500 initially becomes disengaged with the shaft 33B (as shown in FIG. 16B). More specifically, in this state, at least a part of the regulating portion 300 may be present within the movable range Y.

As depicted in FIG. 11B, while the roller housing 400 is separated from the main body 2 of the laser printer 1, the regulating portion 300 may be configured to be disposed outside of the movable range Y of the first bearing member 500. In this case, the same effect as that obtained in the above-described illustrative embodiment may be achieved. FIG. 16B illustrates an example configuration where the regulating portion 300 is located outside of movable range Y, thereby allowing full movement of first bearing portion 500 over movable range Y and allowing detachment of roller 33.

Figure 12:
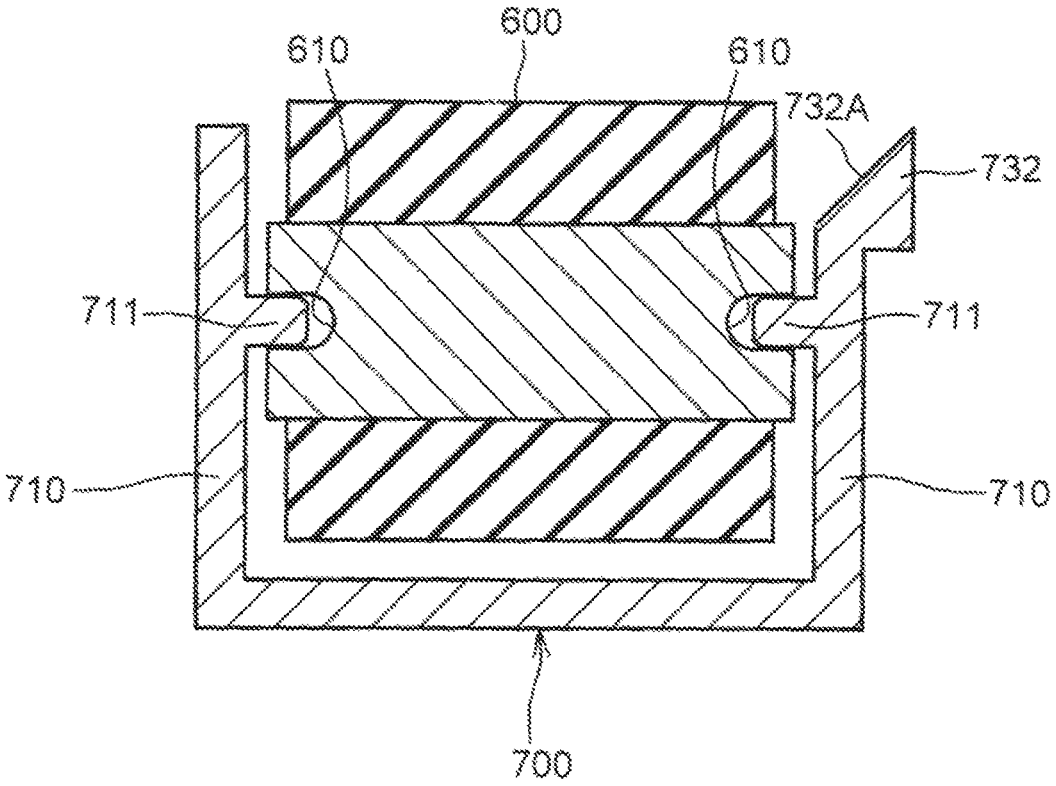
FIG. 12 is a sectional view depicting a first supporting portion and a protrusion in another variation of the illustrative embodiment according to one or more aspects of the disclosure.

In the above-described illustrative embodiment, the first roller may comprise the shafts 33B at the respective ends of the first roller. In other example embodiments, as depicted in FIG. 12, a first roller 600 may have a circular recess 610 in each end. In this case, a roller housing 700 may comprise side walls 710 that may be disposed on opposite sides of the first roller 600 with respect to the axial direction. The side walls 710 may be an example of the first supporting portion of the disclosure. Each side wall 710 may comprise a shaft portion 711 that may protrude inward with respect to the axial direction and be configured to be fitted in the corresponding recess 610. The shaft portion 711 may be an example of the second shaft of the disclosure. The shaft portions 711 may be configured to rotatably hold the first roller 600 via the corresponding recesses 610.

The shaft portions 711, the side walls 710, and the roller housing 700 may be integrally made of resin. The side walls 710 may be configured to be movable along the axial direction by their elastically deforming property. In this case, also, the same effect as that obtained in the above-described illustrative embodiment may be achieved.

Figure 17A:
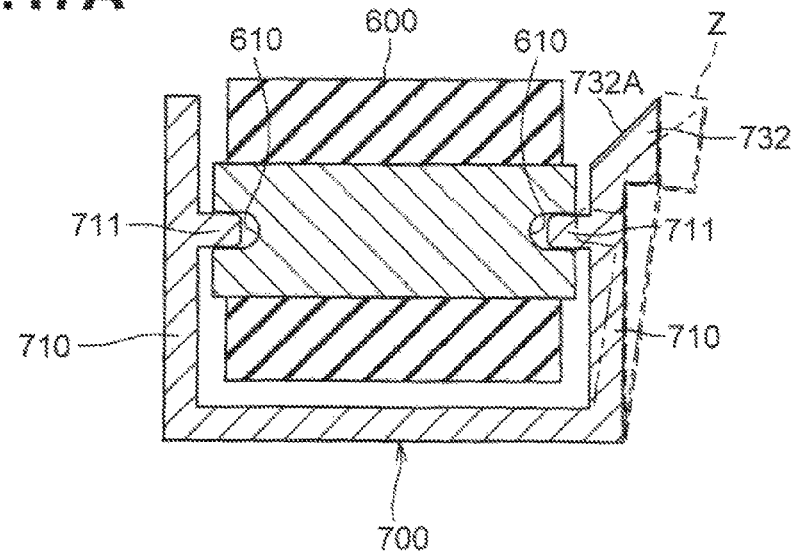
FIGS. 17A, 17B and 17C are sectional views depicting yet another example relationship between a bearing portion and a regulating portion according to one or more aspects of the disclosure.
Figure 17B:
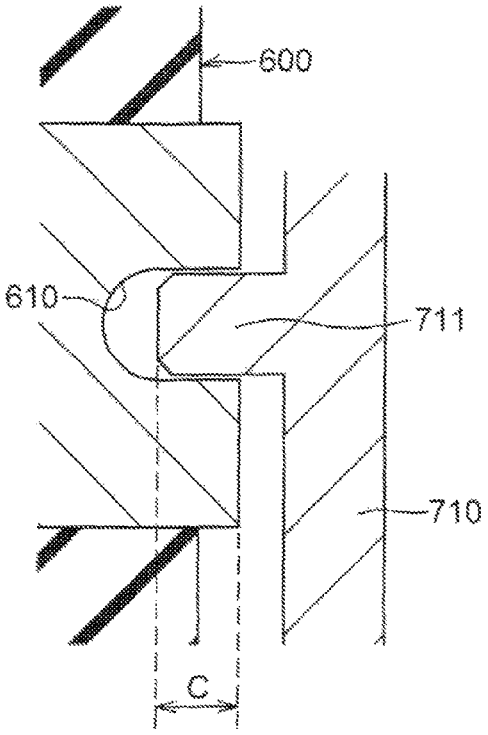
Figure 17C:
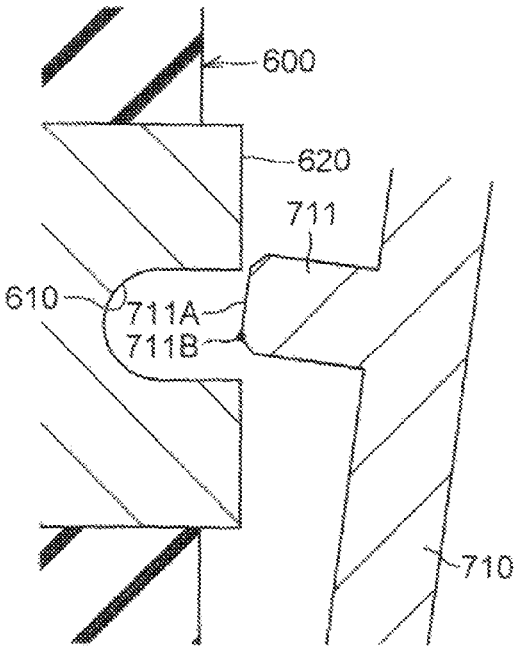

FIGS. 17A-17C illustrates an example configuration where side walls 710 are movable a specified distance C. Distance C may be defined by a distance between an end surface 711A of shaft portions 711 to a part of shaft portions 711 located at a same axial position as a surface of roller 600 immediately adjacent to recess 610 (when the shaft portions 711 are inserted into recesses 610). In another example, the movable range of side walls 710 may be defined as extending from a first position of side walls 710 where shaft portions 711 are inserted into/engaged with corresponding recesses 610 and a second position where shaft portions 711 initially become disengaged/removed from corresponding recesses 610.

Additionally or alternatively, at least a portion of regulating portion 300 may be positioned in the movable range of side walls 710 to prevent disengagement of the shaft portions 711 from the corresponding recesses 610.

In other example configurations where regulating portion 300 is located outside of the movable range of side walls 710, side walls 710 may be free to move to the second position in which shaft portions 711 may be disengaged or removed from corresponding recesses 300 and roller 33 may be removed and replaced.

In the above-described illustrative embodiment, the inner surface of the protrusion 132 with respect to the axial direction may consist of the inclined surface and the flat surface extending downward. In other example embodiments, as depicted in FIG. 12, an inner surface of a protrusion 732 with respect to the axial direction may comprise an inclined surface 732A only that may be inclined toward the outside with respect to the diameter direction and the axial direction.

In the above-described illustrative embodiment, the engaging projection 141 may correspond to an example of the engaging portion of the disclosure. In other example embodiments, the engaging portion may comprise an opening or a recess that may be configured to be engaged with a protrusion of the main body.

As discussed above, aspects of the disclosure may be applied to laser printers such as laser printer 1. However, the aspects described herein may be applied to other roller devices, for example, sheet feeders equipped in facsimile machines, sheet after-treatment devices for copying machines, add-on sheet feeders attachable to printers, document readers for reading a moving document and the like.

In the above-described illustrative embodiment, the first roller may comprise the pickup roller 33 and the second roller may comprise the sheet separating roller 34. In other example embodiments, the first and second rollers may comprise any number of rollers. The number of rollers provided in the holding member may not be limited to two but may be one, or three or more.

In the above-described illustrative embodiment, the regulating member may comprise the regulating portion 300 that may be integral with the main body (e.g., the lower housing 25). However, in other example embodiments, the regulating member may be separately provided from the main body.

While the disclosure has included various example structures and illustrative embodiments, it will be understood by those skilled in the art that other variations and modifications of the structures and embodiments described above may be made without departing from the scope of the disclosure. Other structures and embodiments will be apparent to those skilled in the art from a consideration of the specification or practice of the embodiments disclosed herein. It is intended that the specification and the described examples are illustrative.

What is claimed is:

1. A roller device comprising:

a main body;

a first roller configured to rotate around a first axis line extending in a predetermined axial direction, the first roller including an end portion in the axial direction; and a supporting member including a first supporting portion configured to rotatably support the end portion of the first roller and an engaging portion configured to engage the main body, wherein the first supporting portion is movable within a movable range between a first position and a second position, the first supporting member supporting the end portion of the first roller at the first position, and the first supporting member being disengaged from and disposed outside of and adjacent to the end portion of the first roller at the second position, wherein the supporting member is movable between a third position and a fourth position, the engaging portion engaging the main body when the supporting member is located at the third position, and the engaging portion being disengaged from the main body when the supporting member is located at the fourth position, and wherein the main body including a regulating portion disposed inside the movable range when the supporting member is located at the third position and disposed outside the movable range when the supporting member is located at the fourth position.

2. The roller device according to claim 1, wherein the end portion of the first roller is a shaft, and the first supporting portion is a bearing portion configured to rotatably support the shaft.

3. The roller device according to claim 2, wherein the bearing portion is elastically deformable within the movable range in the axial direction.

4. The roller device according to claim 2, further comprising a second supporting portion including a first opening configured to detachably support the bearing portion in the axial direction.

5. The roller device according to claim 1, wherein the first supporting portion including a second shaft, and the end portion of the first roller includes a recess portion configured to engage the second shaft.

6. The roller device according to claim 5, wherein the first supporting portion is elastically deformable within the movable range in the axial direction.

7. The roller device according to claim 1, wherein the main body includes a second opening configured to open toward an outside of the main body, wherein the supporting member includes a third opening for exposing the first roller, the supporting member being supported by the main body so as to rotate about a second axis line parallel to the first axis line and separated from the first axis line in a diameter direction perpendicular to the first axis line between the third position and the fourth position, the first roller facing the second opening when the supporting member is located at the fourth position, and the first roller being separated from the second opening when the supporting member is located at the third position.

8. The roller device according to claim 1, further comprising a second roller including an end portion in the axial direction, wherein the supporting member includes a third supporting portion configured to rotatably support the end portion of the second roller.

9. The roller device according to claim 8, wherein a peripheral surface of the first roller is made of a material different from a material of which a peripheral surface of the second roller is made.

10. The roller device according to claim 9, wherein the peripheral surface of the first roller is softer than the peripheral surface of the second roller.

11. The roller device according to claim 1, wherein the first supporting portion includes a protrusion portion protruding outwardly in a diameter direction of the first roller, the diameter direction being perpendicular to the first axis line.

12. The roller device according to claim 11, wherein the protrusion portion includes an inner surface adjacent to the first roller in the axial direction, a base side, and a free end side, wherein a portion the inner surface at the free end side is located further from the first roller in the axial direction than a portion of the inner surface at the base side.

13. The roller device according to claim 1, wherein the fourth position is separated from the third position in a diameter direction perpendicular to the axial direction, wherein the supporting member is pivotable between the fourth position and a fifth position via the third position, the fifth position being positioned opposite side of the fourth position with respect to the third position, wherein the engaging portion engages the main body while the supporting member is pivoting between the third position and fourth position, and wherein the regulating portion extends along a moving path of the supporting member between the third position and the fifth position and is disposed in the moving range of the supporting member while the supporting member is moving between the third position and the fifth position.

14. The roller device according to claim 13, wherein the regulating portion includes a facing surface configured to face the first supporting member, wherein the facing surface extends in a same plane perpendicular to the axial direction.

15. A roller device comprising:

a roller having an engaging portion;

a first supporting portion configured to rotatably support the engaging portion of the roller, wherein the first supporting portion is configured to be movable in a moving range between a first position in which the engaging portion is supported by the first supporting portion and a second position at which the engaging portion initially becomes disengaged from the first supporting portion; and a regulating portion positioned within the moving range of the first supporting portion between the first position and the second position.

16. The roller device according to claim 15, wherein the engaging portion comprises a shaft and the first supporting portion includes a bearing portion configured to receive the shaft.

17. The roller device according to claim 16, wherein the bearing portion is elastically deformable to move within the moving range.

18. The roller device according to claim 15, wherein the regulating portion is fixed to a main body and wherein a position of the regulating portion is fixed relative to the main body.

19. The roller device according to claim 15, wherein the first supporting portion includes an opening configured to detachably support a bearing portion in an axial direction of the roller.

20. The roller device according to claim 15, wherein the first supporting portion includes a shaft and the engaging portion comprises a recess configured to receive the shaft.

21. The roller device according to claim 20, wherein the first supporting portion is elastically deformable within the movable range in an axial direction of the roller.

22. The roller device according to claim 15, further comprising:

a main body having an opening configured to open toward an outside of the main body; and a supporting member including the first supporting portion, wherein the supporting member includes another opening configured to expose the roller, and is supported by the main body so as to rotate about an axis parallel to and different from a rotational axis of the roller between a third position and a fourth position, and wherein the roller faces the opening of the main body when the supporting member is in the fourth position, and the roller separates from the opening of the main body when the supporting member is in the third position.

23. The roller device according to claim 15, further comprising:

a supporting member including the first supporting portion; and another roller including an end portion in an axial direction thereof, wherein the supporting member further includes a second supporting portion configured to rotatably support the end portion of the other roller.

24. The roller device according to claim 23, wherein a peripheral surface of the roller is made of a material different from a material from which a peripheral surface of the other roller is made.

25. The roller device according to claim 24, wherein the peripheral surface of the roller is softer than the peripheral surface of the other roller.

26. The roller device according to claim 15, wherein the first supporting portion includes a protrusion portion protruding outwardly in a diameter direction of the roller.

27. The roller device according to claim 26, wherein the protrusion portion includes an inner surface adjacent to the roller in an axial direction of the roller, a base side, and a free end side, wherein a portion of the inner surface at the free end side is located further from the roller in the axial direction than a portion of the inner surface at the base side.

28. The roller device according to claim 15, further comprising:

a main body having an opening configured to open toward an outside of the main body; and a supporting member including the first supporting portion and a supporting member engaging portion, wherein the supporting member is movable between a third position and a fourth position, the supporting member engaging portion engaging the main body when the supporting member is in the third position, and the engaging portion being disengaged from the main body when the supporting member is in the fourth position, wherein the regulating portion is disposed inside the movable range when the supporting member is in the third position and is disposed outside of the movable range when the supporting member is in the fourth position, wherein the fourth position is separated from the third position in a diameter direction perpendicular to an axial direction of the roller, wherein the supporting member is pivotable between the fourth position and a fifth position via the third position, and the fifth position is positioned on an opposite side of the fourth position with respect to the third position, wherein the supporting member engaging portion is configured to engage the main body while the supporting member is pivoting between the third position and fourth position, and wherein the regulating portion extends along a moving path of the supporting member between the third position and the fifth position and is disposed in the moving range of the supporting member while the supporting member is moving between the third position and the fifth position.

29. The roller device according to claim 28, wherein the regulating portion includes a side configured to face the supporting member, wherein the facing side is continuously flat and perpendicular to the axial direction.

30. A roller device comprising:

a roller having a shaft;

a supporting portion having a bearing configured to receive and rotatably support the shaft, wherein the supporting portion is configured to move within a range between a first position in which the shaft is received in the bearing and a second position in which a surface of the bearing facing the roller, in an axial direction of the roller, is located at an axial end surface of the shaft; and a regulating portion located within the moving range of the supporting portion.

31. The roller device according to claim 30, wherein the regulating portion is fixed to a main body and is positionally fixed relative to the main body, wherein the supporting portion is removably detachable from the main body.

32. A roller device comprising:

a roller having a recess;

a supporting portion having a shaft configured to be received within the recess of the roller, wherein the supporting portion is configured to move within a range between a first position in which the shaft is received in the recess and a second position in which an axial surface of the roller adjacent to the recess is located at a same axial position as an end surface of the shaft; and a regulating portion located within the moving range of the supporting portion.

33. The roller device according to claim 32, wherein the regulating portion is fixed to a main body and is positionally fixed relative to the main body, wherein the supporting portion is removably detachable from the main body.

* * * * *